US011303035B2

(12) United States Patent
Wu et al.

(10) Patent No.: US 11,303,035 B2
(45) Date of Patent: Apr. 12, 2022

(54) ANTENNA APPARATUS AND ELECTRONIC DEVICE

(71) Applicant: GUANGDONG OPPO MOBILE TELECOMMUNICATIONS CORP., LTD., Guangdong (CN)

(72) Inventors: Qing Wu, Guangdong (CN); Haijun Tang, Guangdong (CN); Huanhong Liu, Guangdong (CN); Guolin Liu, Guangdong (CN)

(73) Assignee: GUANGDONG OPPO MOBILE TELECOMMUNICATIONS CORP., LTD., Dongguan (CN)

( * ) Notice: Subject to any disclaimer, the term of this patent is extended or adjusted under 35 U.S.C. 154(b) by 0 days.

(21) Appl. No.: 17/230,794

(22) Filed: Apr. 14, 2021

(65) Prior Publication Data

US 2021/0273341 A1 Sep. 2, 2021

Related U.S. Application Data

(63) Continuation of application No. 16/173,574, filed on Oct. 29, 2018, now Pat. No. 11,011,850.

(30) Foreign Application Priority Data

Dec. 29, 2017 (CN) ..... 201711499678.9
Dec. 29, 2017 (CN) ..... 201721928944.0

(51) Int. Cl.
*H01Q 13/18* (2006.01)
*H01Q 1/24* (2006.01)
(Continued)

(52) U.S. Cl.
CPC ..... *H01Q 13/18* (2013.01); *H01Q 1/243* (2013.01); *H01Q 1/44* (2013.01); *H01Q 1/48* (2013.01); *H01Q 5/357* (2015.01)

(58) Field of Classification Search
None
See application file for complete search history.

(56) References Cited

U.S. PATENT DOCUMENTS 10,038,245 B2 7/2018 Choi et al.
10,305,453 B2 * 5/2019 Edwards ..... H03J 1/0083
(Continued)

OTHER PUBLICATIONS

OA1 with English Translation issued in corresponding CN application No. 201711499678.9 dated Jul. 29, 2019.
(Continued)

*Primary Examiner* — Ab Salam Alkassim, Jr.
(74) *Attorney, Agent, or Firm* — Young Basile Hanlon & MacFarlane, P.C.

(57) ABSTRACT

An antenna apparatus and an electronic device are provided. The antenna apparatus includes an excitation source, a conductive member, an antenna radiator comprising a radiator body and a power feeding portion, a first extension portion and a support member, the radiator body comprises a first end and a second end opposite to the first end, and the power feeding portion is disposed at the first end; the first extension portion disposed adjacent to the second end of the antenna radiator, the support member disposed at an end of the first extension portion away from the second end of the antenna radiator, an excitation signal generated by the excitation source transmitted to the support member through the conductive member, the power feeding portion, the first end, the radiator body, the second end, and the first extension portion in sequence.

16 Claims, 4 Drawing Sheets

(51) Int. Cl.

| | |
|---|---|
| ***H01Q 1/48*** | (2006.01) |
| ***H01Q 1/44*** | (2006.01) |
| ***H01Q 5/357*** | (2015.01) |

(56) References Cited

U.S. PATENT DOCUMENTS

| | | | | |
|---|---|---|---|---|
| 10,355,339 | B2 | 7/2019 | Jin et al. | |
| 10,700,416 | B2 | 6/2020 | Jung et al. | |
| 10,819,010 | B2 * | 10/2020 | Lee | H01Q 7/00 |
| 10,854,968 | B2 | 12/2020 | Zhou et al. | |
| 2012/0235866 | A1 | 9/2012 | Kim et al. | |
| 2014/0266922 | A1 * | 9/2014 | Jin | H01Q 5/314 343/702 |
| 2015/0070239 | A1 * | 3/2015 | Hung | H01Q 1/243 343/848 |
| 2015/0097753 | A1 * | 4/2015 | Liou | H01Q 5/40 343/867 |
| 2015/0188213 | A1 * | 7/2015 | Lin | H01Q 5/371 343/702 |
| 2015/0318601 | A1 * | 11/2015 | Lin | H01Q 1/243 343/702 |
| 2017/0054196 | A1 * | 2/2017 | Hu | H01Q 13/103 |
| 2018/0006361 | A1 | 1/2018 | Mai et al. | |
| 2019/0067795 | A1 | 2/2019 | Shin et al. | |
| 2019/0081394 | A1 | 3/2019 | Edwards et al. | |
| 2019/0207318 | A1 | 7/2019 | Wu et al. | |
| 2019/0302842 | A1 | 10/2019 | Sun et al. | |
| 2020/0044311 | A1 | 2/2020 | Gu et al. | |

OTHER PUBLICATIONS

OA2 with English Translation issued in corresponding CN application No. 201711499678.9 dated Jan. 17, 2020.

Non-Final OA issued in corresponding U.S. Appl. No. 16/173,574 dated Sep. 16, 2020.

Final OA issued in corresponding U.S. Appl. No. 16/173,574 dated Nov. 23, 2020.

NOA issued in corresponding U.S. Appl. No. 16/173,574 dated Jan. 22, 2021.

Indian Hearing Notice for IN Application No. 201814040142 mailed Jun. 7, 2021. (2 pages).

* cited by examiner

ANTENNA APPARATUS AND ELECTRONIC DEVICE

CROSS-REFERENCE TO RELATED APPLICATION(S)

The present application is a continuation of U.S. Ser. No. 16/173,574, filed on Oct. 29, 2018, which claims priority to Chinese Patent Application No. 201721928944.0, filed on Dec. 29, 2017, and Chinese Patent Application No. 201711499678.9, filed on Dec. 29, 2017, the contents of all of which are hereby incorporated by reference in their entireties.

TECHNICAL FIELD

The present disclosure relates to the technology field of electronic devices, and more particularly, to an antenna apparatus and an electronic device.

BACKGROUND

With the development of communication technology, electronic devices (especially mobile phones) are developed in a variety of forms and material. Since the metal back cover makes the appearance of the electronic device more beautiful and the metal back cover is more wear-resistant, the back cover (or the battery cover) of the electronic device made of metal material has gradually become the mainstream. When the electronic device communicates with other electronic devices, antennas to radiate an electromagnetic wave signal and receive an electromagnetic wave signal from other electronic devices are required. When the antenna radiates the electromagnetic wave signal, a clearance area is required. However, with the rise of the comprehensive screen technology, the larger screen will occupy the clearance area of the electronic device. As a result, the effect of the electromagnetic wave signal radiated by the antenna is poor, which further leads a poor communication quality of the electronic device.

SUMMARY

In a first aspect, there is provided an antenna apparatus. The antenna apparatus includes an antenna radiator, a support member, and a first extension portion. The antenna radiator includes a radiator body and a power feeding portion. The radiator body includes a first end and a second end opposite to the first end. The power feeding portion is disposed at the first end and configured to receive an excitation signal. The antenna radiator is configured to generate an electromagnetic wave signal according to the excitation signal. The support member and the first extension portion constitute a reference ground of the antenna radiator. The support member includes a first surface and a second surface opposite to the first surface. The support member further includes a side surface located between the first surface and the second surface and adjacent to the radiator body. The first surface is disposed more adjacent to the first end than the second surface. The first extension portion is electrically connected to the support member through the side surface. The first extension portion, the side surface, and the antenna radiator cooperatively define a gap region. The gap region is as at least part of a clearance area of the antenna radiator.

In a second aspect, there is provided an antenna apparatus. The antenna apparatus includes an excitation source, a conductive member, an antenna radiator, a first extension portion, and a support member. The antenna radiator includes a radiator body and a power feeding portion. The radiator body includes a first end and a second end opposite to the first end. The power feeding portion is disposed at the first end. The first extension portion is disposed adjacent to the second end of the antenna radiator. The support member is disposed at an end of the first extension portion away from the second end of the antenna radiator. The support member includes a first surface, a second surface opposite to the first surface, and a side surface disposed between the first surface and the second surface and adjacent to the second end. The first extension portion is electrically connected to the support member through the side surface. An excitation signal is generated from the excitation source and is transmitted to the support member through the conductive member, the power feeding portion, the first end, the radiator body, the second end, and the first extension portion in sequence.

In a third aspect, there is provided an electronic device. The electronic device includes an antenna apparatus, a middle frame, a back cover, and a sealing layer. The antenna apparatus includes an antenna radiator, a support member, a first extension portion. The antenna radiator includes a radiator body and a power feeding portion. The radiator body includes a first end and a second end opposite to the first end. The power feeding portion is disposed at the first end and configured to receive an excitation signal. The support member includes a first surface and a second surface opposite to the first surface. The first surface is disposed more adjacent to the first end than the second surface. The support member further includes a side surface disposed between the first surface and the second surface and adjacent to the radiator body. The first extension portion is disposed adjacent to the antenna radiator and electrically connected to the support member through the side surface. The support member and the first extension portion cooperatively constitute a reference ground of the antenna radiator. The excitation signal oscillates in a path defined by the power feeding portion, the first end, the radiator body, the first extension portion, and the support member to generate an electromagnetic wave signal. The back cover is attached to the middle frame. The middle frame and the back cover define a gap therebetween. The sealing layer is disposed in the gap between the middle frame and the back cover for the electromagnetic wave signal extending therethrough.

BRIEF DESCRIPTION OF DRAWINGS

To better illustrate the technical solutions of implementations of the present disclosure, the following descriptions will briefly illustrate the accompanying drawings described in the implementations. Obviously, the following described accompanying drawings are merely some implementations of the present disclosure. Those skilled in the art can obtain other accompanying drawings according to the described accompanying drawings without creative efforts.

DETAILED DESCRIPTION

Figure 1:
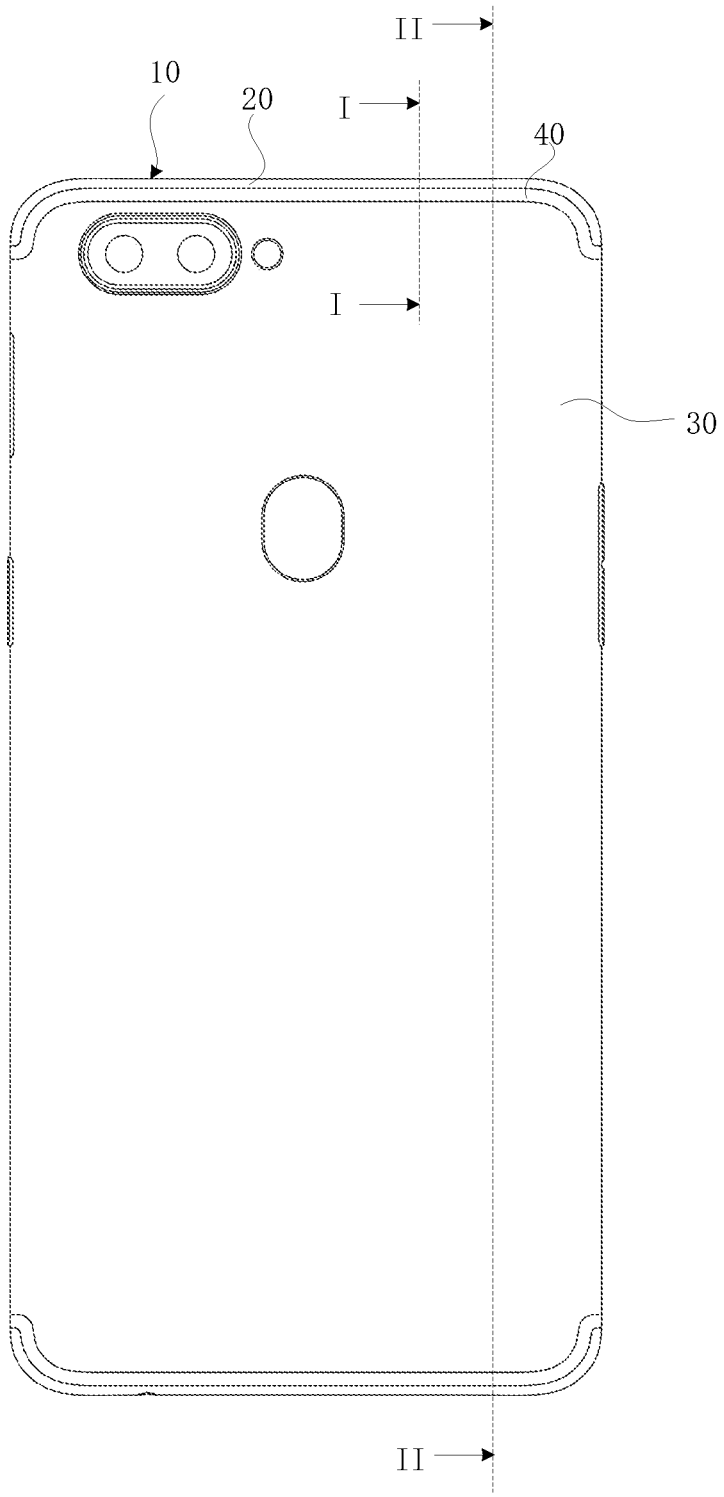
FIG. 1 is a schematic structure view of an electronic device according to a first implementation of the present disclosure.

Technical solutions of implementations of the present disclosure will be described clearly and completely in combination with the accompanying drawings of the implementations of the present disclosure. Obviously, the described implementations are merely a part rather than all of implementations of the present disclosure. All other implementations obtained by those skilled in the art without creative efforts based on the implementations of the present disclosure shall fall within the protection scope of the present disclosure.

In the description of the implementations of the present disclosure, it can be understood that the orientation or positional relationship indicated by the terms "thickness" or the like is based on the orientation or positional relationship shown in the drawings, and is merely for convenience of description and simplified description, rather than implied or indicating that the device or component referred to must have a particular orientation, a structure and operated in a particular orientation, and thus is not to be construed as limiting the present disclosure.

According to implementations of the present disclosure, there is provided an antenna apparatus. The antenna apparatus includes an antenna radiator, a support member, and a first extension portion. The antenna radiator includes a radiator body and a power feeding portion. The radiator body includes a first end and a second end opposite to the first end. The power feeding portion is disposed at the first end and configured to receive an excitation signal. The antenna radiator is configured to generate an electromagnetic wave signal according to the excitation signal. The support member and the first extension portion constitute a reference ground of the antenna radiator. The support member includes a first surface and a second surface opposite to the first surface. The support member further includes a side surface disposed between the first surface and the second surface and adjacent to the radiator body. The first surface is disposed more adjacent to the first end than the second surface. The first extension portion is electrically connected to the support member through the side surface. The first extension portion, the side surface, and the antenna radiator cooperatively define a gap region. The gap region is as at least part of a clearance area of the antenna radiator.

The power feeding portion is disposed at an end surface of the first end away from the second end.

The power feeding portion extends from the first end of the radiator body, and the power feeding portion comprises a groove defined therein for receiving a portion of the conductive member to increase a distance between the power feeding portion and the first extension portion.

According to implementations of the present disclosure, there is provided an antenna apparatus. The antenna apparatus includes an excitation source, a conductive member, an antenna radiator, a first extension portion, and a support member. The antenna radiator includes a radiator body and a power feeding portion. The radiator body includes a first end and a second end opposite to the first end. The power feeding portion is disposed at the first end. The first extension portion is disposed adjacent to the second end of the antenna radiator. The support member is disposed at an end of the first extension portion away from the second end of the antenna radiator. The support member includes a first surface, a second surface opposite to the first surface, and a side surface disposed between the first surface and the second surface and adjacent to the second end. The first extension portion is electrically connected to the support member through the side surface. An excitation signal is generated from the excitation source and is transmitted to the support member through the conductive member, the power feeding portion, the first end, the radiator body, the second end, and the first extension portion in sequence.

According to implementations of the present disclosure, there is provided an electronic device. The electronic device includes a middle frame, a back cover, and a sealing layer. The antenna apparatus includes an antenna radiator, a support member, a first extension portion. The antenna radiator includes a radiator body and a power feeding portion. The radiator body includes a first end and a second end opposite to the first end. The power feeding portion is disposed at the first end and configured to receive an excitation signal. The support member includes a first surface and a second surface opposite to the first surface. The first surface is disposed more adjacent to the first end than the second surface. The support member further includes a side surface disposed between the first surface and the second surface and adjacent to the radiator body. The first extension portion is disposed adjacent to the antenna radiator and electrically connected to the support member through the side surface. The support member and the first extension portion cooperatively constitute a reference ground of the antenna radiator. The excitation signal oscillates in a path defined by the power feeding portion, the first end, the radiator body, the first extension portion, and the support member to generate an electromagnetic wave signal. The back cover is attached to the middle frame. The middle frame and the back cover define a gap therebetween. The sealing layer is disposed in the gap between the middle frame and the back cover for the electromagnetic wave signal extending therethrough.

Implementations of the present disclosure will be detailed below.

Figure 2:
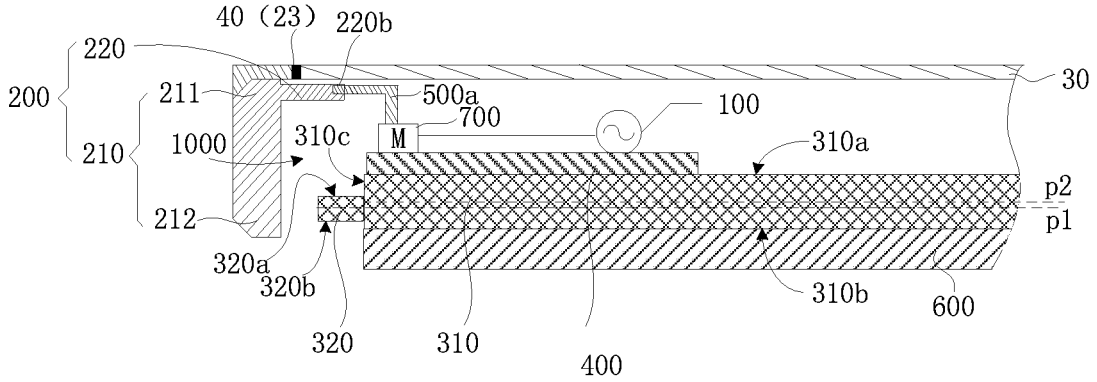
FIG. 2 is a cross sectional schematic view of an electronic device according to a first implementation of the present disclosure taken along the line I-I.

FIG. 1 illustrates a schematic structure view of an electronic device according to a first implementation of the present disclosure. FIG. 2 illustrates a cross sectional schematic view of the electronic device of FIG. 1 taken along the line I-I. The electronic device includes, but is not limited to, a portable device, such as a smart phone, a mobile internet device (MID), an e-book, a play station portable (PSP), or a personal digital assistant (PDA).

Figure 3:
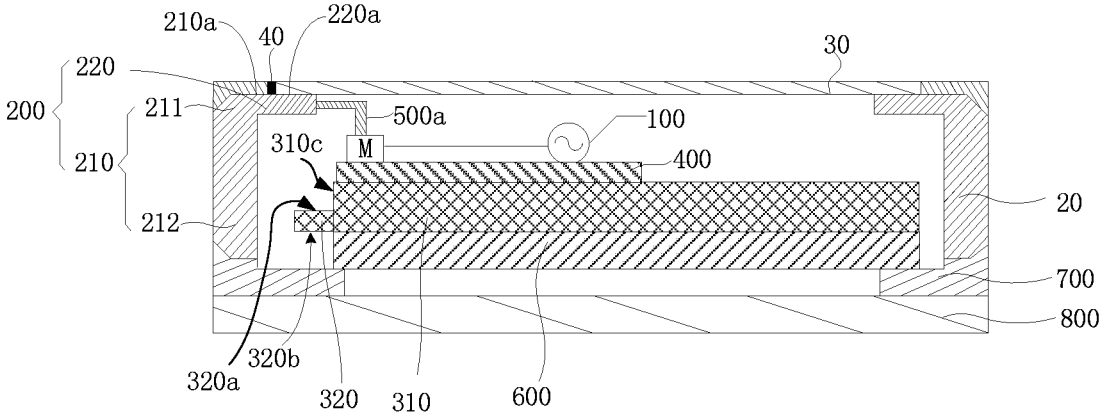
FIG. 3 is a cross sectional schematic view of the electronic device of FIG. 1 taken along the line II-II.

FIG. 3 illustrates a cross sectional schematic view of the electronic device of FIG. 1 taken along the line II-II. The electronic device includes an antenna apparatus 10.

The antenna apparatus 10 includes an excitation source 100, an antenna radiator 200, a support member 310, a first extension portion 320, a circuit board 400, and a conductive member 500*a*. The electronic device further includes a middle frame 20, a back cover 30, a sealing layer 40, a screen 600, a front cover 900 opposite to the back cover 30, and a cover plate 800 attached to the front cover 900.

The middle frame 20 may be a portion of the appearance surface of the electronic device. A portion of the middle frame 20 may serve as the antenna radiator 200.

The middle frame 20 and the back cover 30 define a gap 23 therebetween. The sealing layer 40 is disposed in the gap between the middle frame 20 and the back cover 30. The excitation source 100 is configured for generating an excitation signal. The circuit board 400 is disposed on a side of the support member 310 adjacent to the back cover 30. The circuit board 400 and the support member 310 may be fixed by a fixing member. The fixing member may be, but not limited to a double-sided adhesive tape, a buckle, and so on.

The antenna radiator 200 includes a radiator body 210 and a power feeding portion 220. The radiator body 210 includes a first end 211 and a second end 212 opposite to the first end 211. The power feeding portion 220 is disposed at the first end 211 and configured to receive the excitation signal. The antenna radiator 200 is configured to generate an electromagnetic wave signal according to the excitation signal.

The support member 310 is configured to support the screen 600. The support member 310 is disposed adjacent to the second end 212. The first extension portion 320 is disposed to an end of the support member 310 adjacent to the second end 212, in other words, the support member 310 is disposed at an end of the first extension portion 320 away from the second end 212. The support member 310 and the first extension portion 320 cooperatively constitute a reference ground of the antenna radiator 200. The support member 310 and the first extension portion 320 may be a metal plate in a unitary structure.

The support member 310 includes a first surface 310*a* and a second surface 310*b* opposite to the first surface 310*a*. The support member 310 further includes a side surface 310*c* disposed at a side of the first surface 310*a*, adjacent to the radiator body 210. The first surface 310*a* is disposed more adjacent to the first end 211 than the second surface 310*b*. The first extension portion 320 is disposed next to the side surface 310*c*. The first extension portion 320 may be electrically connected to the support member 310 through the side surface 310*c*. In the implementation, a horizontal central panel p1 of the first extension portion 320 is located between a horizontal central plane p2 of the support member 310 and the second surface 310*b*. The first extension portion 320, the side surface 310*c*, and the antenna radiator 200 cooperatively define a gap region 1000. The gap region 1000 constitutes at least part of a clearance area of the antenna radiator 200. The gap region 1000 is filled with insulating material. The insulating material may not shield the electromagnetic wave signals.

Figure 4:
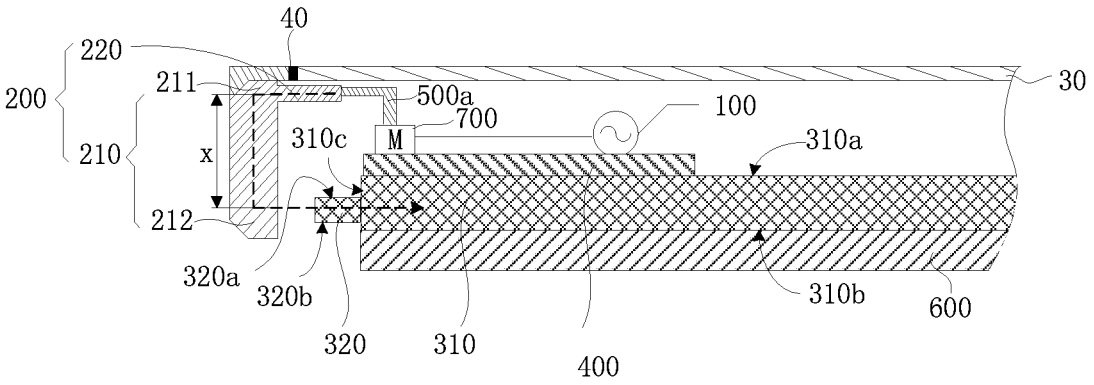
FIG. 4 is a schematic view of a transmission path of an excitation signal of an antenna apparatus of the electronic device of FIG. 2.

FIG. 4 illustrates a schematic view of a transmission path of an excitation signal of an antenna apparatus of the electronic device of FIG. 2. The excitation signal is transmitted on a transmission path defined by the power feeding portion 220, the first end 211, a portion of the radiator body 210, the first extension portion 320, and the support member 310 in sequence. The more adjacent to the second surface 310*b* the first extension portion 320 is disposed, the longer a transmitting path x of the excitation signal transmitted on the radiator body 210 is.

The first extension portion 320 is connected to the first surface 310*a* of the support member 310 through the side surface 310*c* and the horizontal central panel p1 of the first extension portion 320 is located between the horizontal central plane p2 of the support member 310 and the second surface 310*b*. Thus, a distance between the power feeding portion 220 and the first extension portion 320 is increased, that is, a distance between the power feeding portion 220 and the reference ground is increased. Therefore, the effect of the antenna radiator 200 radiating electromagnetic wave signals is improved. Accordingly, the communication quality of the electronic device is improved. The distance between the power feeding portion 220 and the reference ground is increased such that the transmitting path x of the excitation signal transmitted on the radiator body 210 is elongated. In other words, the transmission path of the excitation signal is elongated. In this way, the excitation signal is transmitted more uniformly on the radiator body 210 and the bandwidth of electromagnetic wave signal radiated by the radiator 210 is increased. Thus, the energy of the excitation signal transmitted on the radiator body 210 is prevented to be excessively coupled to the reference ground. Therefore, the energy of the excitation signal is more involved in the radiation to form the electromagnetic wave signal. In this way, the radiation efficiency of the antenna radiator 200 is improved.

In the implementation, the first extension portion 320 includes a third surface 320*a* and a fourth surface 320*b* opposite to the third surface 320*a*. The third surface 320*a* is disposed more adjacent to the first surface 310*a* than the fourth surface 320*b*. A plane in which the third surface 320*a* is located is between a plane in which the first surface 310*a* is located and a plane in which the second surface 310*b* is located.

In other implementations, the fourth surface 320*b* may be in the same plane as the second surface 310*b*. By disposing the fourth surface 320*b* of the first extension portion 320 to be in the same plane as the second surface 310*b* of the support member 310, the distance between the power feeding portion 220 and the first extension portion 320 is further increased when the thickness of the first extension portion 320 (that is, the distance between the third surface 320*a* and the fourth surface 320*b*) is constant. Thus, the effect of the antenna radiator 200 radiating electromagnetic wave signals is further improved. Thereby, the communication quality of the electronic device is further improved. In addition, the distance between the power feeding portion 220 and the reference ground is further increased such that the transmission path of the excitation signal is further increased. Thus, the excitation signal is transmitted even more uniformly on the radiator body 210 and the bandwidth of electromagnetic wave signal radiated by the radiator body 210 is further increased. Furthermore, the energy of the excitation signal transmitted on the radiator body 210 is prevented to be excessively coupled to the reference ground. Thereby, the energy of the excitation signal is more involved in the radiation to form the electromagnetic wave signal to improve the radiation efficiency of the antenna radiator 200.

The excitation source 100 is disposed adjacent to the first surface 310*a* of the support member 310. In the implementation, the excitation source 100 is disposed on a surface of the circuit board 400 away from the support member 310. The excitation source 100 is electrically coupled with the power feeding portion 220 in a direct feeding manner. In the direct feeding manner, the excitation source 100 is electrically coupled with the power feeding portion 220 through the conductive member 500*a*. The conductive member 500*a* may be selected from a group consisting of a conductive wire, a conductive metal sheet, and a conductive elastic sheet. In the implementation, the conductive member 500*a* is a conductive metal sheet. The excitation signal is transmitted to the power feeding portion 220 through the conductive metal sheet.

In another implementation, an end surface 220*a* of the power feeding portion 220 away from the second end 212 may be in alignment with an end surface 210*a* of the radiation body 210 away from the second end 212. Thus, the distance between the power feeding portion 220 and the first extension portion 320 is further increased while the position of the first extension portion 320 relative to the second end 212 is unchanged. Thereby, the effect of the antenna radiator 200 radiating electromagnetic wave signals is improved. Furthermore, the communication quality of the electronic device is improved. In addition, the distance between the power feeding portion 220 and the reference ground is increased. Thus, the transmitting path x of the excitation signal transmitted on the radiator body 210 and the transmission path is further increased such that the transmission of the excitation signal on the antenna radiator 200 is more uniform and the bandwidth of the electromagnetic wave signal radiated by the antenna radiator 200 is enhanced. The energy of the transmitted excitation signal is further prevented to be excessively coupled to the reference ground such that the energy of the excitation signal is more involved in the radiation to form the electromagnetic wave signal.

In an additional implementation, the power feeding portion 220 is disposed at the end surface 211*a* of the first end 211 away from the second end 212, that is, the power feeding portion 220 is disposed at a farthest end surface away from the second end 212. The distance between the power feeding portion 220 and the first extension portion 320 is further increased when the distance between the first extension portion 320 and the second end 212 is unchanged. Thus, the transmitting path x of the excitation signal transmitted on the radiation body 210 and the transmission path are further increased. Therefore, the transmission of the excitation signal on the antenna radiator 200 is more uniform and the bandwidth of the electromagnetic wave signal radiated by the antenna radiator 200 is further increased. In addition, the energy of the transmitted excitation signal is prevented to be excessively coupled to the reference ground such that the energy of the excitation signal is more involved in the radiation to generate the electromagnetic wave signal. Therefore, the radiation efficiency of the antenna radiator 200 is further improved.

Figure 5:
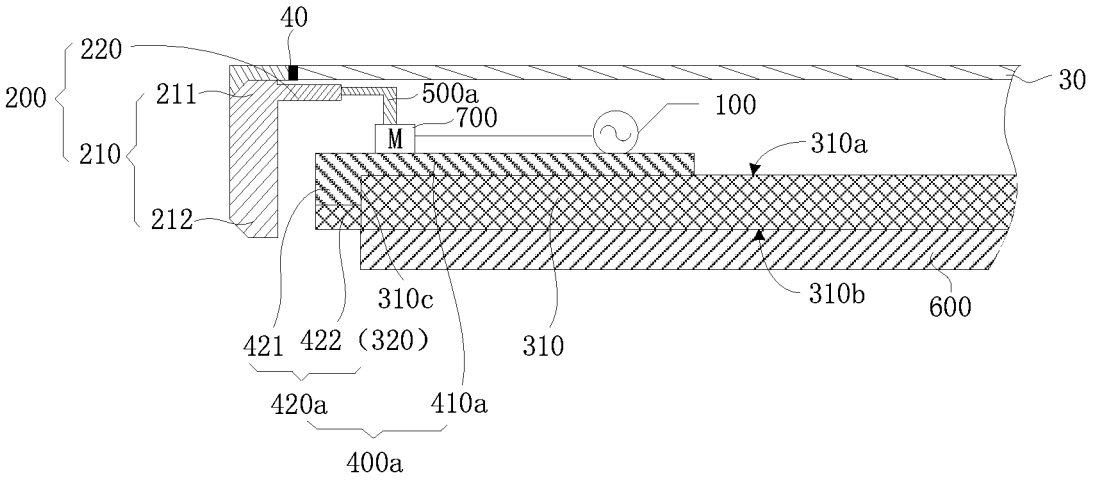
FIG. 5 is a cross sectional schematic view of an electronic device according to a second implementation of the present disclosure.

FIG. 5 illustrates a cross-sectional schematic view of an electronic device according to a second implementation of the present disclosure. The electronic device of the second implementation is similar to the electronic device of the first implementation except that in the second implementation the first extension portion 320 is at least part of a circuit board 400*a* extending from an end of the circuit board 400*a* adjacent to the radiator body 210 along the side surface 310*c*. The circuit board 400*a* is disposed adjacent to the first surface 310*a* of the support member 310. The circuit board 400*a* includes a board body 410*a* and a second extension portion 420*a*. The board body 410*a* is disposed at the first surface 310*a* of the support member 310. The second extension portion 420*a* extends from an end of the board body 410*a* adjacent to the radiation body 210 along the side surface 310*c* in a first direction. The first direction extends from the first surface 310*a* to the second surface 310*b*. The second extension portion 420*a* further includes a first sub-extension portion 421 and a second sub-extension portion 422. The first sub-extension portion 421 is configured to connect the board body 410*a* and the second sub-extension portion 422. The first sub-extension portion 421 is made of insulating material. The second sub-extension portion 422 is made of metal material of the circuit board 400*a* to be the first extension portion 320.

Figure 6:
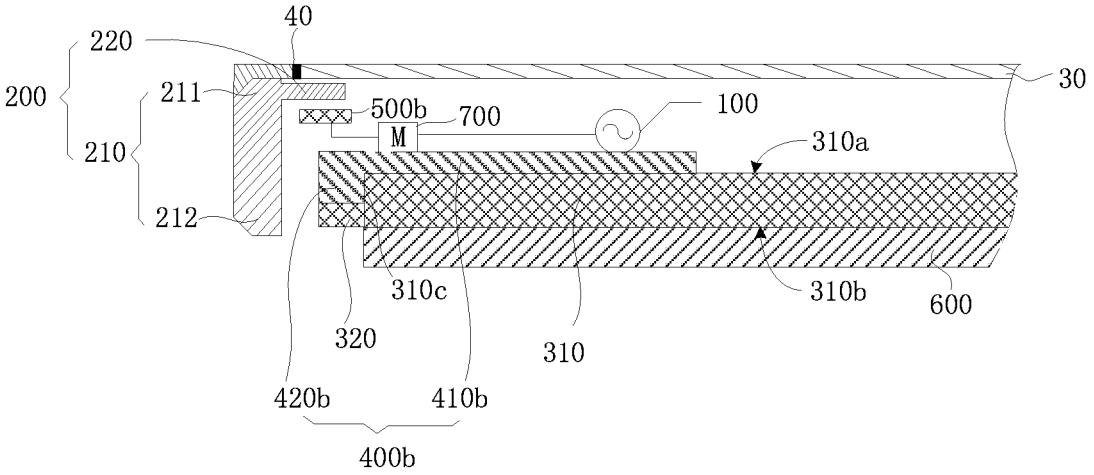
FIG. 6 is a cross sectional schematic view of an electronic device according to a third implementation of the present disclosure.

In an additional implementation, as illustrated in FIG. 6, a circuit board 400*b* is disposed adjacent to the first surface 310*a* of the support member 310. The circuit board 400*b* includes a board body 410*b* and a second extension portion 420*b*. The board body 410*b* is disposed at the first surface 310*a* of the support member 310. The second extension portion 420*b* extends from an end of the board body 410*b* adjacent to the radiation body 210 along the side surface 310*c* in a first direction. The first direction extends from the first surface 310*a* to the second surface 310*b*. An end of the second extension portion 420*b* adjacent to the second surface 310*b* is covered with a metal foil to be the first extension portion 320. The metal foil may be electrically connected to the support member 310.

FIG. 6 illustrates a cross-sectional structure schematic view of the electronic device according to a third implementation of the present disclosure. The electronic device of the third implementation is substantially similar to the electronic device of the second implementation except that in the third implementation the excitation signal is transmitted to the power feeding portion 220 in a coupling feeding manner. In the third implementation, the antenna apparatus further includes a conductive member 500*b*. The conductive member 500*b* and the power feeding portion 220 form a coupling capacitor. The excitation signal is transmitted to the power feeding portion 220 through the coupling capacitor in the coupling feeding manner.

Figure 7:
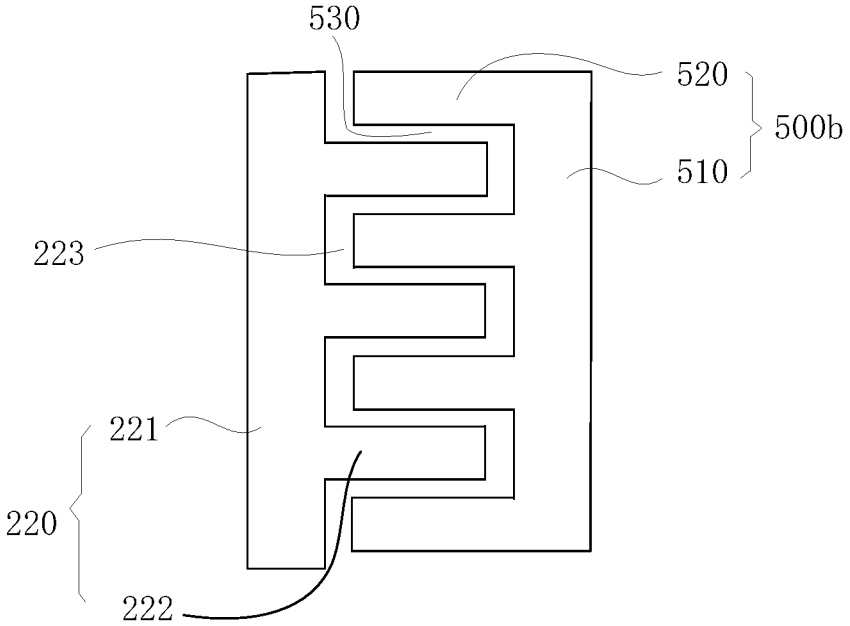
FIG. 7 is a schematic structure view of a conductive sheet and a power feeding portion of an antenna apparatus of FIG. 6.

FIG. 7 illustrates a schematic structure view of the conductive member and the power feeding portion of the antenna apparatus shown in FIG. 6. The conductive member 500*b* is a conductive sheet and includes a conductive body 510, and a plurality of spaced first branches 520. A first gap 530 is defined between two adjacent first branches 520. The power feeding portion 220 includes a feeding body 221 and a plurality of spaced second branches 222 and second branches 222. The feeding body 221 is connected to the second end 212 of the radiator body 210. A second gap 223 is defined between two adjacent second branches 222. The first branch 520 is at least partially disposed in the second gap 223 and the second branch 222 is at least partially disposed in the first gap 530, which enhances the coupling capacitance between the conductive member 500*b* and the power feeding portion 220. Furthermore, the signal transmission quality is improved when the excitation signal is transmitted from the conductive member 500*b* to the power feeding portion 220.

In the implementation, the power feeding portion 220 extends from the first end 211 of the radiator body 210. The power feeding portion 220 includes a groove 220*b* defined therein for receiving a portion of the conductive member 500*a*, as illustrated in FIG. 2. The power feeding portion 220 is provided with the groove 220*b* to receive a portion of the conductive member 500*a* such that the power feeding portion 220 may be as far as possible away from the first extension portion 320, without changing the structure and position of the first extension portion 320 and the second end 212. Thereby, the distance between the power feeding portion 220 and the first extension portion 320 is increased. The power feeding portion 220 extends from the first end 211 of the radiator body 210, which may enhance the structural strength of the antenna radiator 200 (herein being the middle frame 20).

The excitation signal oscillates in the transmission path (indicated by a broken arrow in FIG. 4) formed by the power feeding portion 220, the first end 211, the first extension portion 320, and the support member 310. The electromagnetic wave signal is radiated through the gap region 1000. It can be understood that the transmission path is also applicable to other implementations of the antenna apparatus 10.

It can be understood that the above various implementations and corresponding drawings illustrate components of the electronic device and related to the present disclosure. The main components in the electronic device of the present disclosure are introduced in order to understand the mutual cooperation relationship of components in the electronic device of the present disclosure and the overall architecture.

It can be understood that in the description of the implementations of the present disclosure, the orientation or positional relationship defined by the terms "center", "longitudinal", "lateral", "length", "width", "thickness", "upper", "lower", "previous", "back", "left", "right", "vertical", "horizontal", "top", "bottom", "inside", "outside", "clockwise", "counterclockwise", and so on, is based on the orientation or positional relationship shown in the drawings, and is merely for the convenience of describing the implementations and the simplified description of the present disclosure, and does not indicate or imply that the device or component referred to has a specific orientation, and configuration and operation in a specific orientation, which are should not to be construed as limiting the implementations of the present disclosure. Moreover, the terms "first" and "second" are used for descriptive purposes only and are not to be construed as indicating or implying a relative importance or implicitly indicating the number of technical features indicated. Thus, features defined by "first" or "second" may include one or more of the described features either explicitly or implicitly. In the description of the implementations of the present disclosure, the meaning of "a plurality of" is two or more unless specifically and specifically defined otherwise.

In the description of the implementations of the present disclosure, it should be noted that the terms "installation", "connected", and "couple" should be understood broadly, unless explicitly stated and defined otherwise, for example, may be a fixed connection, or a movable connection, or an integrated connection; may also be a mechanical connection, an electrical connection, or a communication with each other; may be directly connected, or may be indirectly connected through an intermediate medium, may be an internal communication of two components or an interactions between two components. For those skilled in the art, the specific meanings of the above terms in the implementations of the present disclosure can be understood according to specific situations.

In the implementations of the present disclosure, unless explicitly stated and defined otherwise, a first feature "on" or "below" a second feature may include a direct contact of the first and second features, and may also include the first feature and the second feature are not in direct contact but through an additional features located therebetween. Moreover, a first feature "on", "above", and "over" a second feature includes the first feature directly above and diagonally above the second feature, or merely indicates that the first feature is higher than the second feature. A first feature "below", "under", and "beneath" a second feature includes the first feature directly below and diagonally below the second feature, or merely indicates that the first feature is lower than the second feature.

The present disclosure provides many different implementations or examples for implementing different structures of the implementations of the present disclosure. In order to simplify the disclosure of implementations of the present disclosure, the components and settings of the specific examples are described. Of course, they are merely examples and are not intended to limit the present disclosure. In addition, the implementations of the present disclosure may repeat reference numerals and/or reference letters in different examples, which are for the purpose of simplicity and clarity, and do not indicate the relationship between the various implementations and/or arrangements discussed by themselves. Moreover, implementations of the present disclosure provide examples of various specific processes and materials, but one of ordinary skill in the art will recognize the use of other processes and/or the use of other materials.

In the description of the present disclosure, the descriptions with reference to terms "one implementation", "some implementations", "illustrative implementation", "example", "specific example" or "some examples", and the like indicate that a specific features, structures, materials, or characteristics described in connection with the examples or illustrative implementations are included in at least one implementation or example of the present disclosure. In the present specification, the schematic representation of the above terms does not necessarily mean the same implementation or example. Furthermore, the specific features, structures, materials, or characteristics described may be combined in a suitable manner in any one or more implementations or examples.

Any process or method description in the flowcharts or otherwise described herein may be understood as a module, a segment or a portion of a code representing executable instructions including one or more steps for implementing a particular logical function or process. And the scope of the preferred implementations of the present disclosure includes additional implementations which may not be in the order shown or discussed. The functions may be performed in a substantially simultaneous manner or in a reverse order depending on the functions involved, which should be understood by those skilled in the art to which the implementations of the present application pertain.

The logic and/or steps represented in the flowchart or otherwise described herein, for example, may be considered as an ordered list of executable instructions for implementing logical functions, and may be embodied in any computer readable medium, may be used by an instruction execution system, an apparatus, or a device (such as a computer-based system, a system including a processor, or other system that can fetch instructions from and execute instructions from an instruction execution system, an apparatus, or a device), or may be used in conjunction with theses instructions to execute a system, an apparatus, or a device. In this specification, a "computer-readable medium" can be any apparatus that can contain, store, communicate, propagate, or transport a program for use in an instruction execution system, apparatus, or device, or in conjunction with such an instruction execution system, apparatus, or device. More specific examples (non-exhaustive list) of computer readable media include electrical connections (electronic devices) having one or more wires, portable computer disk cartridges (magnetic devices), random access memory (RAM), read only memory (ROM), erasable editable read only memory (EPROM or flash memory), fiber optic devices, and portable compact disk read only memory (CDROM). In addition, the computer readable medium may even be a paper or other suitable medium on which the program can be printed, as it may be optically scanned, for example by paper or other medium, followed by editing, interpretation or, if appropriate, other suitable method proceeds to obtain the program electronically and then store it in computer memory.

It can be understood that portions of the implementations of the present disclosure can be implemented in hardware, software, firmware, or a combination thereof. In the above-described implementations, multiple steps or methods may be implemented in software or firmware stored in a memory and executed by a suitable instruction execution system. For example, if implemented in hardware, as in another implementation, it can be implemented by any one or combination of the following techniques well known in the related art, such as, discrete logic circuits with logic gates for implementing logic functions on data signals, application specific integrated circuits (ASICs) with suitable combinational logic gates, programmable gate arrays (PGAs), field programmable gate arrays (FPGAs), and so on.

One of ordinary skill in the art can understand that all or part of the steps carried by the method of the above implementations can be implemented by a program to instruct related hardware. And the program can be stored in a computer readable storage medium when executed and includes one or a combination of the steps of the method implementations In addition, each functional unit in each implementation of the present disclosure may be integrated into one processor, or each unit may exist physically separately, or two or more units may be integrated into one module. The above integrated modules can be implemented in the form of hardware or in the form of software functional modules. If implemented in the form of software functional modules and sold or used as separate products, the integrated modules may also be stored in a computer readable storage medium. The storage medium mentioned above may be a read only memory, a magnetic disk, an optical disk, or the like.

The implementations of the present disclosure have been shown and described above, which can be understood that the foregoing implementations are illustrative and are not to be construed as limiting the scope of the present disclosure. Changes, modifications, substitutions and variations of the implementations are also considered as the scope of protection of the present disclosure.

What is claimed is:

1. An antenna apparatus, comprising:

an excitation source;

a conductive member;

an antenna radiator comprising a radiator body and a power feeding portion, the radiator body comprising a first end and a second end opposite to the first end, and the power feeding portion being disposed at the first end;

a first extension portion disposed adjacent to and forming a gap from the second end of the antenna radiator; and a support member disposed at an end of the first extension portion away from the second end of the antenna radiator, the support member comprising a first surface, a second surface opposite to first surface, and a side surface disposed between the first surface and the second surface and adjacent to the second end, wherein the excitation source is adjacent to the first surface;

wherein the first extension portion is electrically connected to the support member through the side surface, and an excitation signal generated by the excitation source is transmitted to the support member through the conductive member, the power feeding portion, the first end, the radiator body, the second end, and the first extension portion in sequence;

wherein a horizontal central plane of the first extension portion is located between a horizontal central plane of the support member and the second surface of the support member.

2. The antenna apparatus according to claim 1, wherein the first extension portion comprises a third surface and a fourth surface opposite to the third surface, the third surface is disposed more adjacent to the first surface than the fourth surface, and a plane in which the third surface is located is between a plane in which the first surface is located and a plane in which the second surface is located.

3. The antenna apparatus according to claim 1, wherein the first extension portion comprises a third surface and a fourth surface opposite to the third surface, the third surface is disposed more adjacent to the first surface than the fourth surface, and the fourth surface is in the same plane as the second surface.

4. The antenna apparatus according to claim 1, wherein the support member and the first extension portion are a metal plate in a unitary structure.

5. The antenna apparatus according to claim 1, wherein the power feeding portion is disposed at an end surface of the first end away from the second end.

6. The antenna apparatus according to claim 1, wherein the power feeding portion extends from the first end of the radiator body, and an end surface of the power feeding portion away from the second end is in alignment with an end surface of the radiator body away from the second end to increase a distance between the power feeding portion and the first extension portion.

7. The antenna apparatus according to claim 1, further comprising a circuit board, wherein the circuit board is disposed adjacent to the first surface, and the first extension portion is at least part of the circuit board extending from an end of the circuit board adjacent to the radiator body along the side surface.

8. The antenna apparatus according to claim 7, wherein the circuit board comprises a board body and a second extension portion, the board body is disposed at the first surface, the second extension portion extends from an end of the board body adjacent to the radiator body in a first direction which extending from the first surface to the second surface, the second extension portion further comprises a first sub-extension portion and a second sub-extension portion, the first sub-extension portion is configured to connect the board body and the second sub-extension portion, the first sub-extension portion is made of non-conductive material, and the second sub-extension portion is made of metal material of the circuit board and is to be the first extension portion.

9. The antenna apparatus according to claim 7, wherein the circuit board comprises a board body and a second extension portion, the board body is disposed at the first surface, the second extension portion extends from an end of the board body adjacent to the radiator body in a first direction which extending from the first surface to the second surface, and an end of the second extension portion adjacent to the second surface is covered with a metal foil to be the first extension portion.

10. The antenna apparatus according to claim 1, wherein the excitation source is disposed adjacent to the first surface of the support member, and the excitation source is electrically coupled with the power feeding portion in a direct feeding manner to transmit the excitation signal to the radiator body through the power feeding portion.

11. The antenna apparatus according to claim 10, wherein the excitation source is electrically coupled with the power feeding portion through the conductive member.

12. The antenna apparatus according to claim 11, wherein the power feeding portion extends from the first end of the radiator body, and the power feeding portion comprises a groove defined therein for receiving a portion of the conductive member to increase a distance between the power feeding portion and the first extension portion.

13. The antenna apparatus according to claim 11, further comprising an impedance matching circuit electrically connected between the excitation source and the conductive member.

14. The antenna apparatus according to claim 1, wherein the power feeding portion extends from the first end of the radiator body, the conductive member and the power feeding portion form a coupling capacitor, and the excitation signal is transmitted to the power feeding portion through the capacitor in a coupling feeding manner.

15. The antenna apparatus according to claim 14, wherein the conductive member comprises a conductive body and a plurality of spaced first branches, neighbor first branches define a first gap therebetween, the power feeding portion comprises a feeding body and a plurality of spaced second branches, the conductive body is connected to the second end of the radiator body, neighbor second branches define a second gap therebetween, and the first branches are at least partially located in the second gaps and the second branches are at least partially located in the first gaps.

16. An electronic device, comprising:

an antenna apparatus, comprising:

an excitation source;

a conductive member;

an antenna radiator comprising a radiator body and a power feeding portion, the radiator body comprising a first end and a second end opposite to the first end, and the power feeding portion being disposed at the first end;

a first extension portion disposed adjacent to and forming a gap from the second end of the antenna radiator; and a support member disposed at an end of the first extension portion away from the second end of the antenna radiator, the support member comprising a first surface, a second surface opposite to first surface, and a side surface disposed between the first surface and the second surface and adjacent to the second end, wherein the excitation source is adjacent to the first surface;

wherein the first extension portion is electrically connected to the support member through the side surface, and an excitation signal generated by the excitation source is transmitted to the support member through the conductive member, the power feeding portion, the first end, the radiator body, the second end, and the first extension portion in sequence;

wherein a horizontal central plane of the first extension portion is located between a horizontal central plane of the support member and the second surface of the support member;

a middle frame;

a back cover attached to the middle frame, the middle frame and the back cover defining a gap therebetween; and a sealing layer disposed in the gap between the middle frame and the back cover for the electromagnetic wave signal extending therethrough.

* * * * *